US008832864B1

(12) United States Patent
Braden

(10) Patent No.: US 8,832,864 B1
(45) Date of Patent: Sep. 16, 2014

(54) IV ACCESSIBLE INFANT SLEEPER

(71) Applicant: Susan J. Braden, Rolling Meadows, IL (US)

(72) Inventor: Susan J. Braden, Rolling Meadows, IL (US)

( * ) Notice: Subject to any disclaimer, the term of this patent is extended or adjusted under 35 U.S.C. 154(b) by 0 days.

(21) Appl. No.: 14/044,097

(22) Filed: Oct. 2, 2013

(51) Int. Cl.
*A41D 11/00* (2006.01)
*A41B 9/00* (2006.01)
*A41D 10/00* (2006.01)

(52) U.S. Cl.
CPC ..... *A41D 11/00* (2013.01); *A41D 10/00* (2013.01)
USPC ..... 2/80; 2/114

(58) Field of Classification Search
CPC ... A41D 15/00; A41D 13/1236; A41D 10/00; A41D 11/00; A41B 13/08; A41B 13/00
See application file for complete search history.

(56) References Cited

U.S. PATENT DOCUMENTS

| | | | | | |
|---|---|---|---|---|---|
| 459,106 | A | * | 9/1891 | Fifield | 2/114 |
| 1,462,515 | A | | 7/1923 | McElroy | |
| 1,489,046 | A | * | 4/1924 | Thompson | 2/114 |
| 1,758,740 | A | * | 5/1930 | Gale | 2/78.2 |
| 1,792,610 | A | * | 2/1931 | Skinner | 2/75 |
| 2,291,861 | A | * | 8/1942 | Astrove | 2/80 |
| 2,465,622 | A | | 3/1949 | Widetsky | |
| 2,472,302 | A | * | 6/1949 | Litt et al. | 2/80 |
| 2,605,471 | A | * | 8/1952 | Kephart | 2/83 |
| 2,613,359 | A | * | 10/1952 | Boyce | 2/69.5 |
| 2,636,287 | A | * | 4/1953 | Heilbronner | 36/9 R |
| 2,677,130 | A | * | 5/1954 | O'Hayer | 2/75 |
| 2,679,049 | A | | 5/1954 | Daniels | |
| 2,738,512 | A | * | 3/1956 | Winer | 2/80 |
| 2,849,718 | A | | 9/1958 | Wheelock | |
| 3,111,676 | A | * | 11/1963 | Artzt et al. | 2/80 |
| 3,259,126 | A | * | 7/1966 | Greiert | 128/873 |
| 3,435,461 | A | * | 4/1969 | Artzt | 2/83 |
| 3,568,213 | A | * | 3/1971 | Mason | 2/80 |
| 4,382,303 | A | * | 5/1983 | Lunt | 2/114 |
| 4,688,270 | A | * | 8/1987 | Denicola et al. | 2/102 |
| 4,726,076 | A | * | 2/1988 | Douez | 2/69 |
| 4,745,634 | A | * | 5/1988 | Douez | 2/69 |
| 4,843,648 | A | | 7/1989 | Goldberg | |
| 5,062,159 | A | * | 11/1991 | Jakub | 2/114 |
| 5,133,086 | A | * | 7/1992 | Truitt et al. | 2/114 |
| D362,742 | S | * | 10/1995 | Bergman | D2/745 |
| 5,564,126 | A | | 10/1996 | Chou | |
| 5,621,917 | A | | 4/1997 | Howsden | |
| 5,806,096 | A | | 9/1998 | Pennington | |
| 5,991,923 | A | * | 11/1999 | Maria | 2/83 |
| 6,477,710 | B1 | | 11/2002 | Ojoyeyi | |
| 6,647,552 | B1 | * | 11/2003 | Hogan | 2/114 |
| 6,684,407 | B2 | | 2/2004 | Crooks St. Pierre | |
| 6,694,521 | B1 | | 2/2004 | Hopkins | |
| D510,176 | S | | 10/2005 | Cellucci | |
| 7,305,716 | B1 | | 12/2007 | Richards | |
| 7,526,816 | B2 | | 5/2009 | Shak | |
| 7,810,172 | B2 | | 10/2010 | Williams | |
| 7,882,570 | B2 | | 2/2011 | Krier | |
| 8,356,365 | B2 | | 1/2013 | Wolfson | |
| 2003/0177563 | A1 | * | 9/2003 | Reich | 2/75 |

(Continued)

*Primary Examiner* — Amber Anderson
(74) *Attorney, Agent, or Firm* — Perkins IP Law Group LLC; Karen Blouin; Jefferson Perkins

(57) ABSTRACT

An infant sleeper used to cover an infant in a medical setting. The sleeper has non-continuous fasteners that allow medical personnel and caregivers access to the infant's body for the purposes of attaching medical equipment, medical checkups and general caregiving.

13 Claims, 4 Drawing Sheets

(56) References Cited

U.S. PATENT DOCUMENTS

2005/0094703 A1 5/2005 McConnell et al.
2007/0250985 A1* 11/2007 Harris et al. ..... 2/111
2010/0017933 A1 1/2010 Taylor-Barry
2010/0125930 A1 5/2010 Burrell, IV

* cited by examiner

IV ACCESSIBLE INFANT SLEEPER

BACKGROUND OF THE INVENTION

Infants in medical settings such as neonatal intensive care units (NICU) and hospital nurseries are often connected to external medical instrumentation such as heart monitors, temperature monitors, intravenous lines, respirators, catheters and feeding tubes which means the infants have attachments and devices running from the external machines to their bodies. While in the medical setting, protocols mandate that the infants undergo regular checks, including checks on external attachments and devices used by the various medical instrumentation. For example, intravenous sites must be checked frequently to ensure the sites are not leaking, infected or swollen. In addition to medical checks, routine infant care such as diaper changes must be performed on a regular basis. To accommodate the necessity of medical personnel having frequent access to the infants' bodies, skin and diapers, most infants are placed in NICU bassinets or beds with minimal or no clothing. Most of the infants in medical settings are clothed only in a diaper.

Remaining unclothed, however is not the optimal condition for the infants. Medically fragile infants, and many infants in general, have a difficult time regulating their own body temperature. Clothing, especially warm full body coverings, aid the infants in keeping warm and preventing cold stress by trapping body heat. In turn, when clothed the infants no longer expend calories keeping warm, and instead gain weight quicker which potentially leads to shorter hospital stays. Having the infants in clothing also helps the parents bond in a positive way when they visit the babies, which aids the infants' overall health and welfare.

Thus a need exists for an infant garment that covers the infant's body providing comfort and warmth while allowing access to the infant's body for medical device maintenance and monitoring and routine infant care.

SUMMARY OF THE INVENTION

According to one aspect of the invention, a fabric infant sleeper is provided which is optimized for use in medical environments. The sleeper has an upper right front panel, an upper left front panel, a lower front panel and a rear panel which are joined together such that the medical practitioner has access to areas of the infant that are key to the infant's medical and general care. The access is accomplished by providing separable seams formed with non-continuous fasteners, including without limitation snaps, buttons or hook-and-loop closures in addition to sewn or otherwise fused or joined continuous seams. Specifically the upper right front panel is joined to the rear panel by seams along the side and possibly the sleeve bottom, and non-continuous fasteners along the shoulder and possibly the sleeve top. The upper left front panel is also joined to the rear panel by seams along the side and possibly the sleeve bottom, and non-continuous fasteners along the shoulder and possibly the sleeve top. In addition, the upper left and right front panels are joined to each other by non-continuous fasteners. The lower front panel is joined to the rear panel by seams on the bottom of the legs and in between the leg portions and non-continuous fasteners along a portion of either side and is joined to the upper panels by non-continuous fasteners. The non-continuous fasteners provide possible openings on both shoulders of the infant, between the upper right and left upper panels, between the right and left upper panels and the lower front panel and between the rear panel and lower front panel allowing tubes and wires to traverse the space between the infant and the medical device The present invention provides an advantage to other infant sleepers or clothes that do not provide the full range of accessibility for various medical devices. In addition, the present invention provides an advantage to the infant wearing no clothes by providing protection for the infant's skin, preventing cold stress leading to quicker weight gain and promoting bonding between the infant and the infant's parents. Furthermore, the openings in the sleeper allow the parents to hold the baby chest to chest in a kangaroo care technique, while still allowing the baby to remain warm and protected.

BRIEF DESCRIPTION OF THE DRAWINGS

Further aspects of the invention and their advantages can be discerned in the following detailed description, in which like characters denote like parts and in which.

DETAILED DESCRIPTION

The present invention provides a sleeper for use by an infant in a medical setting such as an NICU or hospital nursery. In the illustrated embodiment shown in FIG. 1, a sleeper indicated generally at 100 is preferably made from a soft fleece material. The sleeper 100 may also be made from cotton fabric, polyester blend fabric, or a flame retardant fabric. The front of the sleeper 100 has an upper right panel 102 and an upper left panel 104 which may extend to form sleeves. The front of the sleeper has a lower panel 106 to fit the lower part of the infant's body. In this specification, "left" and "right" refer to the frame of reference of the wearer rather than that of the figures.

Figure 2:
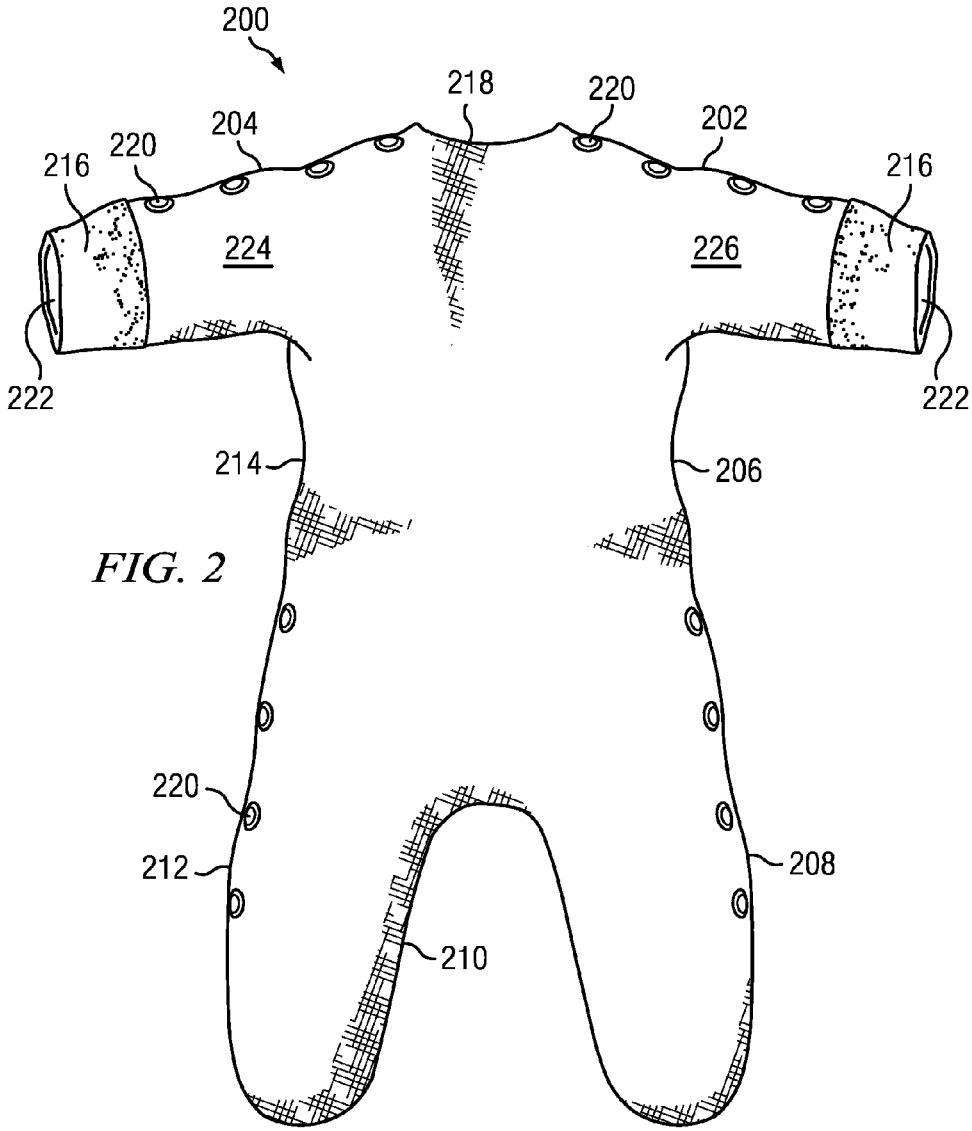
FIG. 2 is a plan view of a rear panel of the sleeper shown in FIG. 1.
Figure 2A:
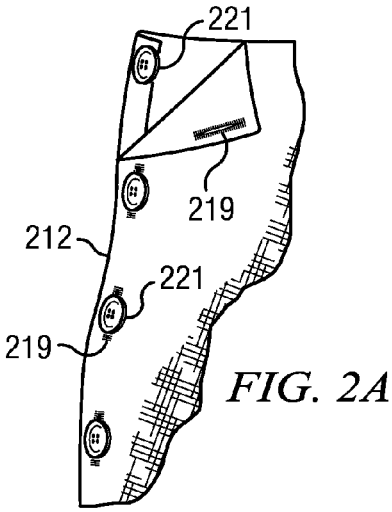
FIG. 2A is a detail view of a second embodiment of the sleeper showing buttons and button holes.
Figure 2B:
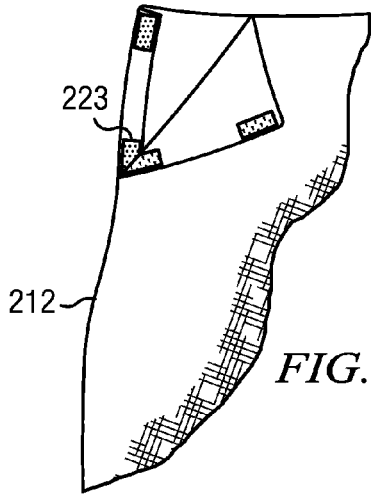
FIG. 2B is a detail view of a third embodiment of the sleeper showing hook and loop closures.

As shown in FIG. 2, the rear panel of the sleeper, shown generally at 200, has right top margin 202, a left top margin 204, and a neck margin 218 in between the right top margin 202 and the left top margin 204. The rear panel 200 also has an upper right margin 206, an upper left margin 214, a lower right margin 208 extending downwardly from the upper right margin 206, and a lower left margin 212 extending downwardly from the upper left margin 214. An inside margin 210 extends between the lower right 208 and lower left 212 margins. In addition, some embodiments may include a rear left sleeve section 224 and a rear right sleeve section 226. In the embodiments with sleeve sections, there may be hand pockets 216 adjacent the hand openings 222. As seen in FIG. 2, non-continuous fasteners 220 are disposed in spaced relation with each other along the right top margin 202, the top left margin 204, the lower left margin 212 and the lower right margin 208. The non-continuous fasteners 220 are preferably snaps but may also be hook-and-loop closures 223 (such as Velcro®; See FIG. 2B), buttons 221 and button holes 219 (See FIG. 2A) or any other connecting apparatus that does not create a continuous joined seam when implemented.

Figure 3:
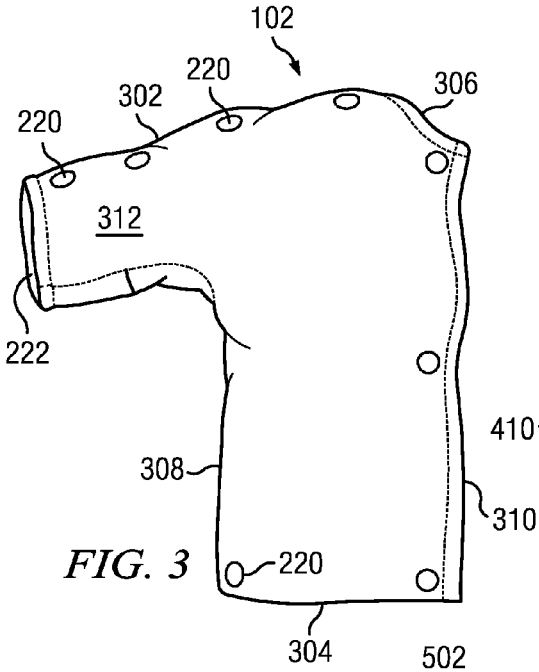
FIG. 3 is a plan view of the upper right front panel of the sleeper shown in FIG. 1.

The upper right front panel of the sleeper is shown generally as 102 in FIG. 3. The upper right front panel 102 has a top margin 302, neck margin 306 and a bottom margin 304. A right margin 308 extends between the top 302 and bottom 304 margins and a left margin 310 extends between the neck margin 306 and the bottom margin 304. The neck margin 306 extends leftward from the right top margin 302. Some embodiments may have an upper right sleeve section 312. Non-continuous fasteners 220 are disposed along the top margin 302, left margin 310, and bottom margin 304.

Figure 4:
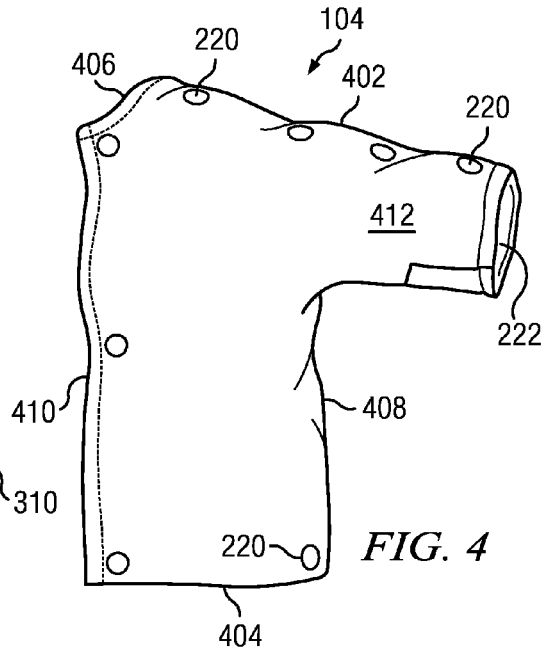
FIG. 4 is a plan view of the upper left front panel of the sleeper shown in FIG. 1.

The sleeper has an upper left front panel generally shown at 104 in FIG. 4. The upper left panel 104 can be a mirror image of the upper right panel 102. The upper left front panel 104 has a top margin 402, neck margin 406 and a bottom margin 404. A left margin 408 extends between the top margin 402 and bottom margin 404 and a right margin 410 extends between the neck margin 406 and the bottom margin 404. The neck margin 406 extends rightward from the left top margin 402. Some embodiments may have an upper left sleeve section 412. Several non-continuous fasteners 220 are disposed along the top margin 402, right margin 410, and bottom margin 404.

Figure 5:
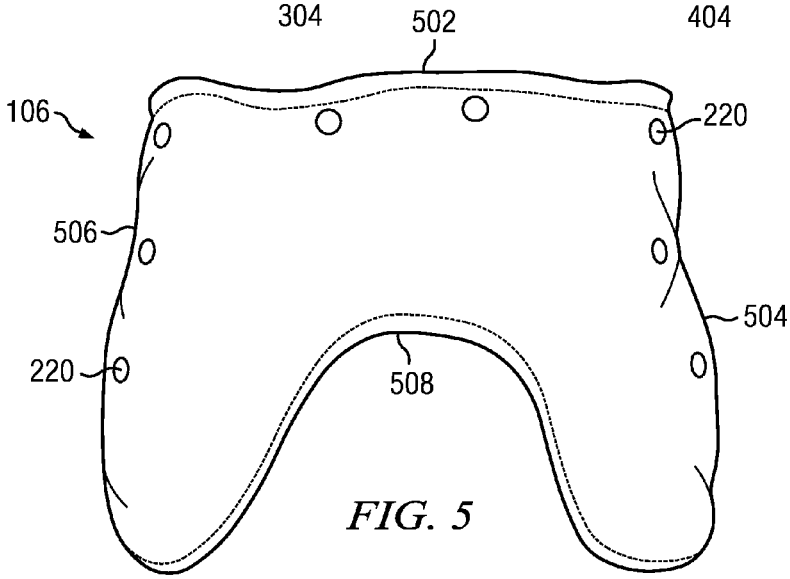
FIG. 5 is a plan view of the lower front panel of the sleeper shown in FIG. 1.

The lower front panel of the sleeper is shown generally at 106 in FIG. 5. The lower front panel 106 has a top margin 502, a right margin 506, a left margin 504 and an inside margin 508. The inside margin 508 extends between the right margin 506 and the left margin 504. The top margin 502 extends between the right margin 506 and the left margin 504. Non-continuous fasteners 220 are disposed in the top margin 502, right margin 506 and left margin 504.

Figure 1:
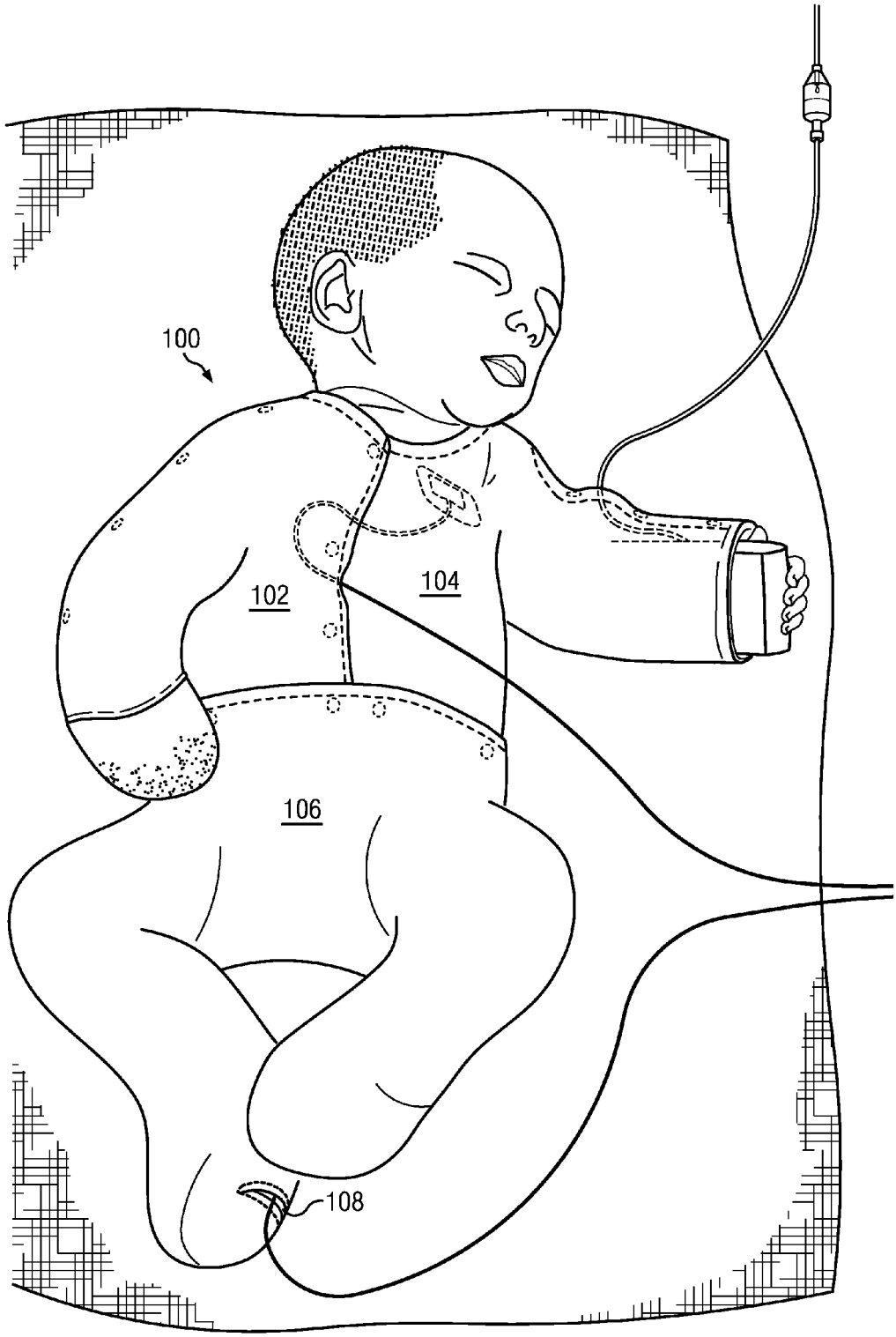
FIG. 1 is a front view of an infant wearing a sleeper according to the invention.

The sleeper 100 is formed by attaching the upper right front panel 102, upper left front panel 104, lower front panel 106 and rear panel 200 to each other. The right margin 308 of the upper right front panel 102 is joined to the upper right margin 206 of the rear panel 200 by a seam. Non-continuous fasteners, rather than a seam, join the right top margin 302 of the upper right front panel 102 to the right top margin 202 of the rear panel 200. In embodiments that include an upper right sleeve section 312 and a rear right sleeve section 226, the non-continuous fasteners 220 would extend over the right shoulder and the right arm of the infant. The non-continuous fasteners 220 give the medical caregiver easy access to the infant's right arm for tests and the placement of intravenous lines. The space between inside the sleeve section 312 would be wide enough to accommodate an IV board as shown in FIG. 1. In addition, the non-continuous fasteners 220 have openings in between them through which tubes and wires can traverse the space between the infant and the medical device, while leaving the baby covered and warm. (See FIG. 1) The sleeper 100 also provides a heel slit 108 through which medical devices can be attached to the infant's foot. As shown the heel slit 108 is on the right foot of the sleeper but it may be on either foot or both feet.

A plurality of non-continuous fasteners 220 join the left margin 310 of the upper right front panel 102 to the right margin 410 of the upper left front panel 104 thereby covering the upper front portion of the body of the infant. The non-continuous fasteners 220 give the medical caregiver easy access to the infant's chest for performing medical checks including checking vital organs, for medical tests and procedures and for the placement of sensors and measuring devices. Once again, the non-continuous fasteners 220 allow for medical equipment that requires access to the infant's upper body to be positioned while the infant can remain covered and warm—only the area requiring medical attention will be exposed to the outside air.

Non-continuous fasteners 220 also join the bottom margin 304 of the upper right front panel 102 to the top margin 502 of the lower front panel 106 to cover a lower front portion of the body of the infant. The non-continuous fasteners 220 provide easy access to the infant's umbilical area.

The upper left front panel 104 is connected to the rear panel 200 and the lower front panel 106 similar to how the upper right front panel 102 is jointed to the rear panel 200 and the lower front panel 106. The left margin 408 of the upper left front panel 104 is joined to the upper left margin 214 of the rear panel 200 by a seam. Non-continuous fasteners 220 join the left top margin 402 of the upper left front panel 104 to the left top margin 204 of the rear panel 200. In embodiments that include an upper left sleeve section 412 and a rear left sleeve section 224, the non-continuous fasteners 220 would extend over the right shoulder and the right arm of the infant. Non-continuous fasteners 220 join the bottom margin 404 of the upper left front panel 104 to the top margin 502 of the lower front panel 106 to cover the lower front portion of the infant.

Finally, non-continuous fasteners 220 join the right margin 506 of the lower front panel 106 to the lower right margin 208 of the rear panel 200. Additionally, non-continuous fasteners 220 join the left margin 504 of the lower front panel 106 to the lower left margin 212 of the rear panel 200 while the inside margin 508 of the lower front panel 106 is joined to the inside margin 210 of the rear panel 200 by a seam. The combination of the non-continuous fasteners 220 at the top margin 502 of the front lower panel 106 and the non-continuous fasteners 220 at the lower right margin 506 and lower left margin 504 of the front lower panel 106 allow for easy access to the infant's lower body. Diaper changes may be accomplished with this accessible area.

Figure 7:
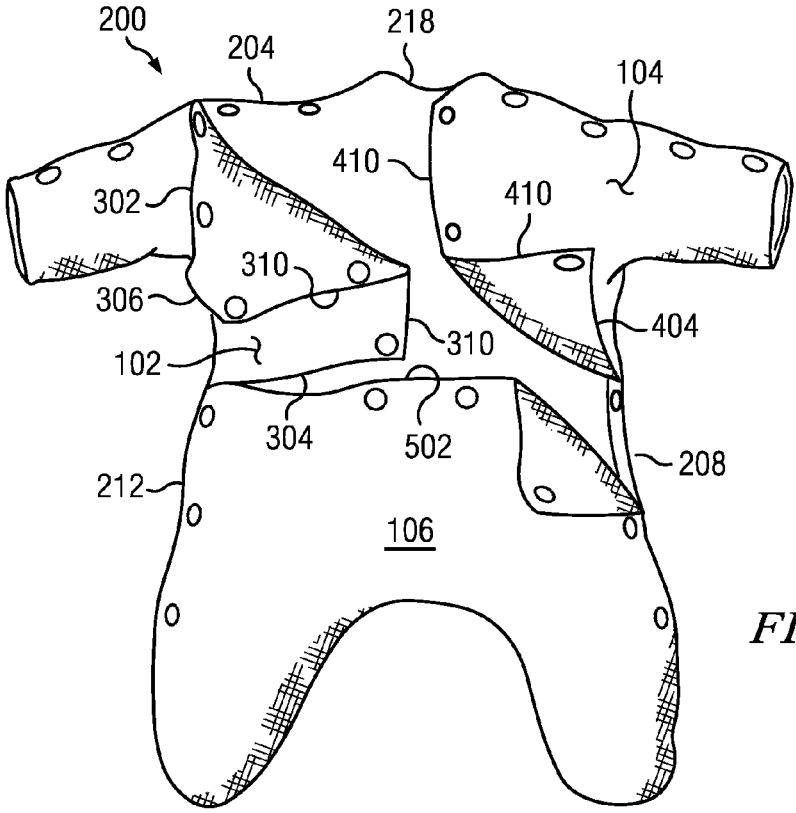
FIG. 7 is a view of the infant sleeper shown in FIG. 1, illustrating various claims.

FIG. 7 shows the sleeper 100 in its fully configured state with some of the accessibility features of the sleeper deployed. The left top margin 204 of the rear panel 200 is partially separated from the top margin 302 of the upper right front panel 102 thereby providing access to the infant's right arm and shoulder. The left margin 310 of the upper right front panel 102 is separated from the right margin 410 of the upper left front panel 104 which provides access to the infant's chest area. Finally, the bottom margins 304, 404 of both the upper right front panel 102 and the upper left front panel 104 are detached from the top margin 502 of the lower front panel 106 providing access to the infant's umbilical area and facilitating diaper changes.

Figure 8:
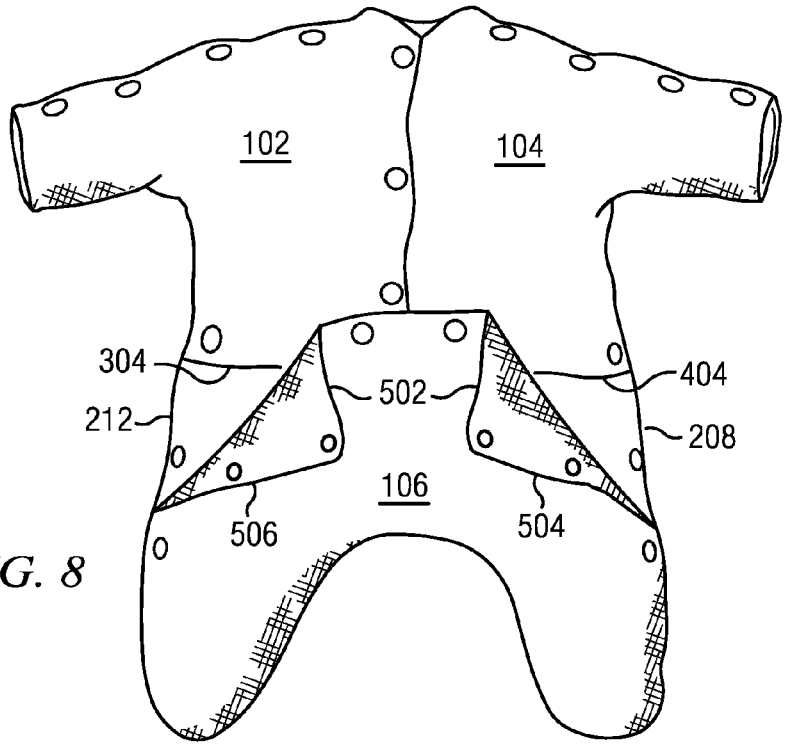
FIG. 8 is a view of the infant sleeper of FIG. 1, illustrating certain bottom closures.

FIG. 8 shows the sleeper's accessibility for diaper changes. Here, the infant's upper body is fully covered by the upper right front panel 102 and the upper left front panel 104. However, the top margin 502 of the lower front panel 106 is detached from the lower margins 304, 404 of both the upper right front panel 102 and the upper left front panel 104. In addition, the right margin 506 of the lower front panel 106 is detached from the lower left margin 212 of the rear panel 200 and the left margin 504 of the lower front panel 106 is detached from the lower right margin 208 of the rear panel. The infant's diaper can then be changed by only removing the bottom of the infant from the sleeper 100.

Figure 6:
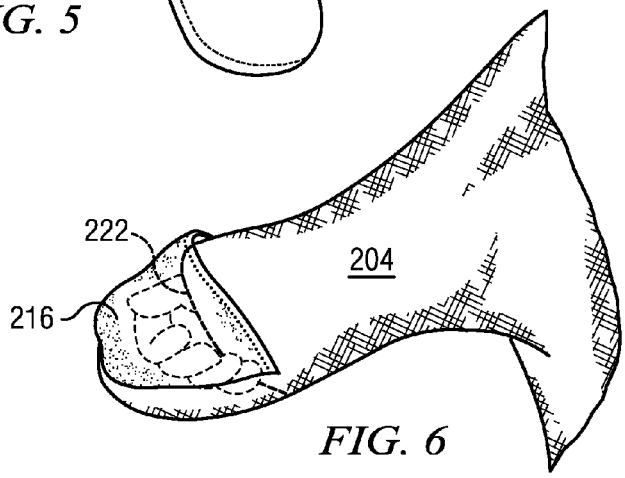
FIG. 6 is detail showing the hand pocket.

In embodiments that have right and left sleeves, hand pockets 216 may be disposed on the rear left sleeve section 224 and the rear right sleeve section 226 adjacent to the hand openings 222. These hand pockets 216 are designed to be folded over the infant's hands as shown in FIG. 6. The hand pockets 216 prevent the infant from removing tubes and lines, scratching him or herself and provide additional warmth and protection for the infant's hands.

In summary, an infant sleeper 100 has been shown and described which allows for access to medical equipment and other infant care, provides covering and warmth to the infant in medical situations, and helps promote bonding between the parents and infant. While illustrated embodiments of the present invention have been described and illustrated in the appended drawings, the present invention is not limited thereto but only by the scope and spirit of the appended claims.

I claim:

1. A method for keeping an infant clothed while providing medical personnel with the ability to assess intravenous therapy sites and attach, position and separate medical devices, comprising the steps of:

providing a garment;

placing the infant on a rear panel of an unfastened fabric sleeper;

covering a right shoulder of the infant's body by joining a right top margin of an upper right front panel of the sleeper to a right top margin of the rear panel by a first plurality of non-continuous fasteners;

covering an upper front portion of the infant's body by joining a left margin of the upper right front panel of the sleeper to a right margin of the upper left front panel by a second plurality of non-continuous fasteners;

covering at least some of the lower front portion of the infant's body by joining a bottom margin of the upper right front panel of the sleeper to a top margin of the lower front panel by a third plurality of non-continuous fasteners;

covering a left shoulder of the infant's body by joining a left top margin of the upper left front panel of the sleeper to a left top margin of the rear panel by a fourth plurality of non-continuous fasteners;

covering at least some of the lower front portion of the infant's body by joining a bottom margin of the upper left front panel of the sleeper to the top margin of the lower front panel by a fifth plurality of non-continuous fasteners, such that the joining of the top margin of the lower front panel to the bottom margins of the upper left front panel and the upper right front panel covers the lower front portion of the infant's body;

joining the right margin of the lower front panel of the sleeper to a lower right margin of the rear panel by a sixth plurality of non-continuous fasteners; and joining the left margin of the lower front panel of the sleeper to the lower left margin of the rear panel by a seventh plurality of non-continuous fasteners, each of the pluralities of fasteners, defining, when closed, openings; inserting one or more medical equipment tubes or wires through one or more of said openings defined by the closed non-continuous fasteners; and keeping the infant clothed while medical personnel asses intravenous therapy sites or attach, position, and separate medical devices.

2. The method of claim 1, wherein at least some of the non-continuous fastener is a plurality of spaced-apart snaps.

3. The method of claim 1, wherein at least some of the non-continuous fastener is a plurality of spaced-apart hook and loop attachments.

4. The method of claim 1, wherein at least some of the non-continuous fasteners include spaced-apart button and button hole sets.

5. The method of claim 1, wherein the fabric is fleece.

6. The method of claim 1, wherein the fabric is cotton.

7. The method of claim 1, wherein the fabric is a polyester blend.

8. The method of claim 1, wherein the fabric is flame retardant.

9. The method of claim 1, wherein the upper right front panel and the rear panel form a right arm section of the sleeper and the upper left front panel and the rear panel form a left arm section of the sleeper, a hand covering being included on the right and left arm sections.

10. The method of claim 1, wherein the upper right front panel and the rear panel form a right arm section of the sleeper and the upper left front panel and the rear panel form a left arm section of the sleeper, the front right arm section having a bottom seam opposed to the right top margin of the upper right front panel, the front left arm section having a bottom seam opposed to the left top margin of the upper left front panel, a distance between each top margin and an associated bottom seam adapted to accommodate an IV board.

11. The method of claim 1, wherein the lower front panel has at least one slit which is not located on the top right, left or inside margins of the lower front panel.

12. The method of claim 1, and further including the steps of:

joining one or more of the pluralities of non-continuous fasteners around the medical equipment tubes and wires.

13. The method of claim 1, and further including the steps of:

dimensioning right and left arm sections of the sleeper to enclose an arm of the infant and an IV board attached thereto;

attaching an IV board to a right or left arm of the infant; and closing a bottom seam of a respective one of the left and right arm sections to a top margin of an associated one of the upper right or upper left front panels to enclose the last said infant arm and the IV board in the sleeper.

* * * * *